US007845988B2

(12) United States Patent
Hsiao et al.

(10) Patent No.: US 7,845,988 B2
(45) Date of Patent: Dec. 7, 2010

(54) ELECTRICAL CONNECTOR CONTACT

(75) Inventors: Shih-Wei Hsiao, Tu-Cheng (TW); Wen-Yi Hsieh, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 53 days.

(21) Appl. No.: 12/419,314

(22) Filed: Apr. 7, 2009

(65) Prior Publication Data

US 2009/0253313 A1 Oct. 8, 2009

(30) Foreign Application Priority Data

Apr. 7, 2008 (TW) ..... 97205827 U

(51) Int. Cl.
*H01R 13/24* (2006.01)

(52) U.S. Cl. ..... 439/700; 439/66; 439/824

(58) Field of Classification Search ..... 439/66, 439/482, 700, 824, 841
See application file for complete search history.

(56) References Cited

U.S. PATENT DOCUMENTS 4,385,754 A * 5/1983 Waite ..... 267/71
7,025,602 B1 * 4/2006 Hwang ..... 439/66
7,300,288 B1 * 11/2007 Chen ..... 439/66
7,559,769 B2 * 7/2009 Hsiao et al. ..... 439/66
7,559,806 B2 * 7/2009 Lin et al. ..... 439/700
2008/0064236 A1 * 3/2008 Lin et al. ..... 439/82
2009/0253313 A1 * 10/2009 Hsiao et al. ..... 439/786
2009/0311886 A1 * 12/2009 Hsieh et al. ..... 439/66
2010/0035472 A1 * 2/2010 Hsiao et al. ..... 439/626
2010/0035483 A1 * 2/2010 Hsieh et al. ..... 439/816
2010/0068947 A1 * 3/2010 Hsiao et al. ..... 439/786

FOREIGN PATENT DOCUMENTS

TW M 322638 11/2007

* cited by examiner

*Primary Examiner*—James Harvey
(74) *Attorney, Agent, or Firm*—Andrew C. Cheng; Wei Te Chung; Ming Chieh Chang

(57) ABSTRACT

An electrical connector contact adapted for connecting a chip to a circuit board comprises a first terminal, a second terminal electrically connecting with the first terminal and a spring. The first terminal is defined with a first abutting portion and a contact beam extending from one end of the abutting portion. The second terminal is defined with a second abutting portion and a elastic beam extending from one end of the second abutting portion. The spring is set between the first and second abutting portion with the two ends thereof separately abutting against the first abutting portion and second abutting portion. Along the contact beam there forms a retain slot, the elastic beam mating with and retain in the retain slot. A good electrical performance can be achieved according to the structure of the invention and the contact is convenient for assembling and changing.

14 Claims, 3 Drawing Sheets

ELECTRICAL CONNECTOR CONTACT

BACKGROUND OF THE INVENTION

1. Field of the Invention

The present invention relates to the art of electrical connector contact, and more particularly to electrical connector contact adapted for connecting a chip with a circuit board.

2. Description of the Related Art

As is well known that Land Grid Array (LGA) connector is widely used in Integrated Circuit (IC) industry, which is used for connecting two separate electrical elements, such as connecting a chip to a published circuit board. The contact of this kind of connector generally includes two terminals and a spring, one terminal touches with the chip and another terminal touches with the circuit board, and the spring is set between outside of the two terminals to provide spring strength therebetween, the two terminals engage with each other within the spring. Relative technique is disclosed in a Chinese tai wan patent with an issue number M 322638, which discloses a relative contact according with the present invention.

Although said kind of electrical connector contacts can realize an electrical connecting function, the two terminals of said kind of electrical connector contact engage with each other by a plate to plate mating method, during moving process, a loosing mistake may accrue between the two terminals, that may result in a bad connecting and further to influence the electrical performance therebetween. On the other hand, according to the conventional connector, when the spring is under a unpressed condition, the two terminals are separate from each other. When assembling the contact into the insulating housing, must hold one terminal firstly, then assemble another terminal, or when changing one terminal of the contact from the connector that also need to assemble the connector by many steps, that will influence the applicant of the product and the convenience during changing one terminal.

Hence, it's necessary to ameliorate the exist connector contacts to overcome said drawbacks.

SUMMARY OF THE INVENTION

An object of the invention is to provide an electrical connector contact, which has a good electrical performance and can be assembled efficiently.

An electrical connector contact adapted for connecting a chip with a circuit board according to an embodiment of the present invention, which comprises a first terminal, a second terminal electrically connecting with the first terminal and a spring. The first terminal is defined with a first abutting portion and a contact beam extending from one end of the abutting portion. The second terminal is defined with a second abutting portion and an elastic beam extending from one end of the abutting portion. The spring is set between and abuts against the first abutting portion and the second abutting portion. A retain slot is formed on the surface of contact beam, the elastic beam is received in the retain slot by abutting against the surface of the retain slot.

In the connector according with the present invention, the first terminal and the second terminal engage with each other through a method that the elastic beam of the second terminal clamp the retain slot on the first terminal, according to the structure of the contact according with the present invention, said loosing and bad connecting drawbacks of conventional connector won't occur in the present invention. On the other hand, the engaging that the elastic beam clamps the retain slot makes the two terminal a whole constructer, which is convenient for assembling the connector or changing a terminal therefrom.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
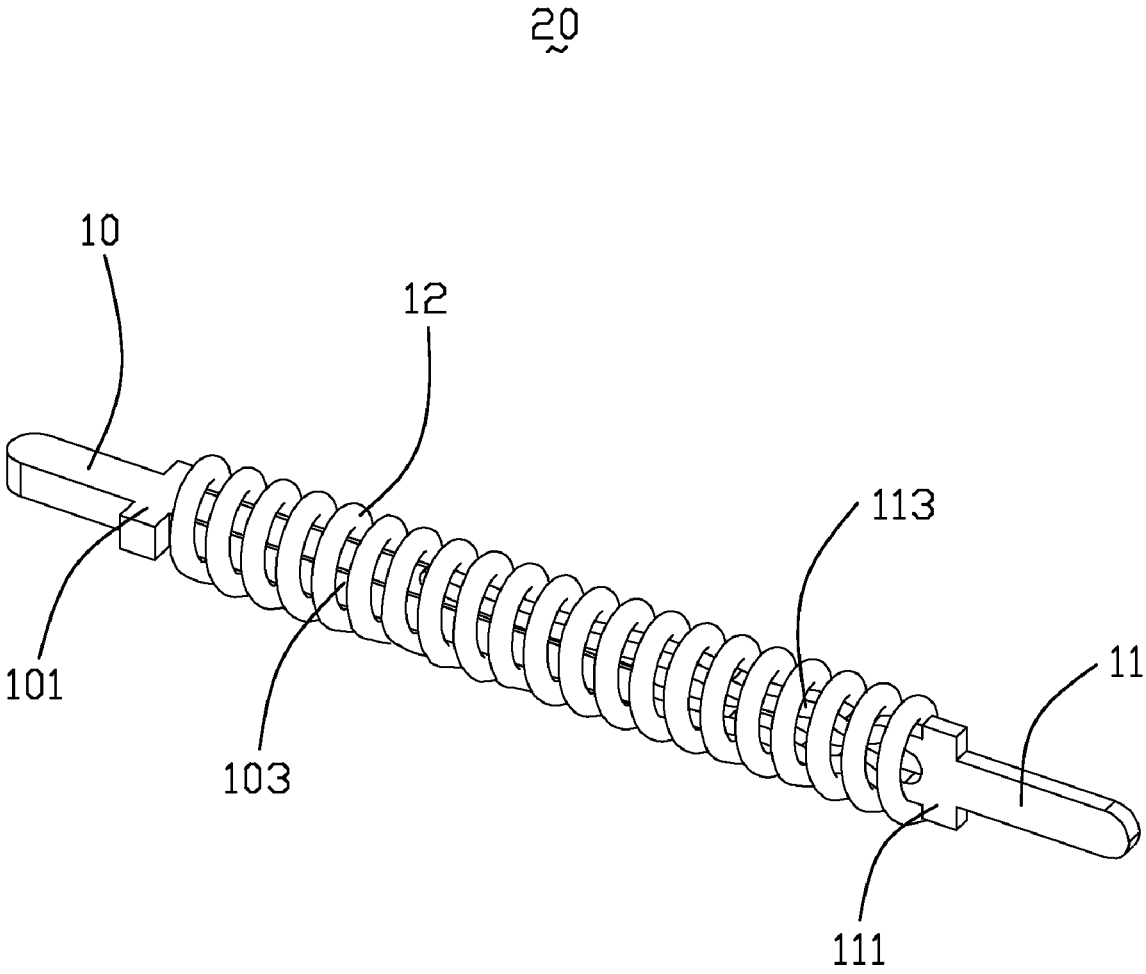
FIG. 1 is a perspective view of an electrical connector contact according to an embodiment of the present invention.
Figure 2:
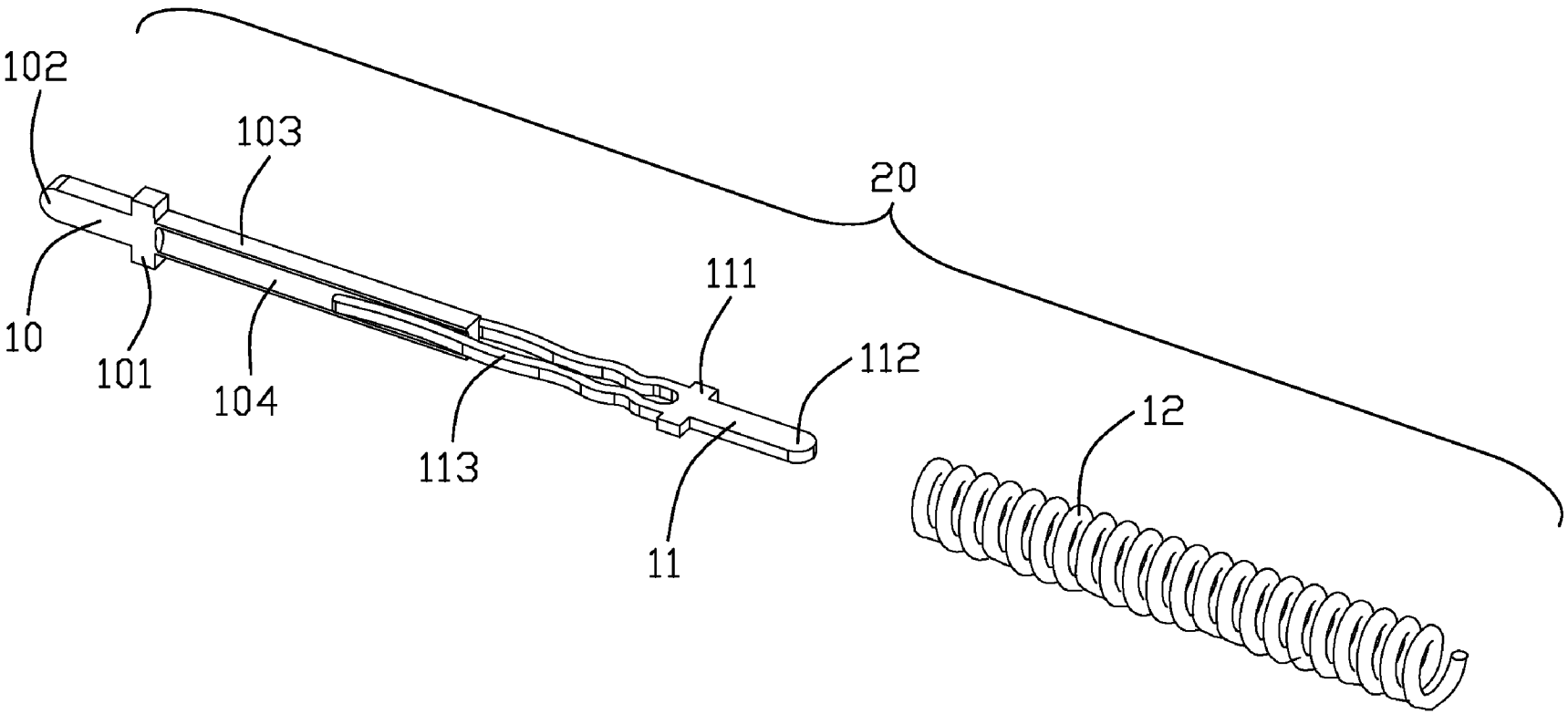
FIG. 2 is a partly-exploded view of the electrical connector of FIG. 1.
Figure 3:
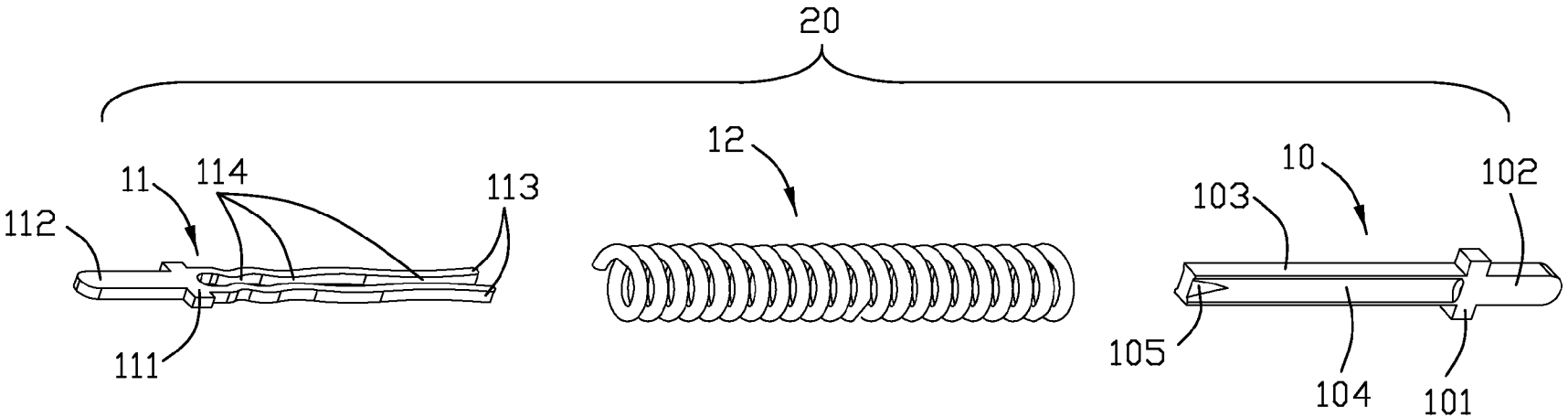
FIG. 3 is an exploded, perspective view of the electrical connector contact of FIG. 1.

Referring to FIGS. 1 to 3, in one preferred embodiment of the present invention, an electrical connector contact 20 adapted for connecting an external electrical element(such as a chip, which is not shown in the Figs.) to a circuit board(not shown, but also can be other electrical elements), includes a first terminal 10, a second terminal 11 and a spring 12 connecting the first terminal 10 and the second terminal 11, the first terminal 10 and the second terminal 11 are both metal plate.

The first terminal 10 includes a first abutting portion 101 with a quadrate board shape, a first mating portion 102 extending from one end of the first abutting portion 101 for electrically connecting with an external electrical element, and a contact beam 103 extending from the other end of the first abutting portion 101 towards the second terminal 11. On both side surfaces of the contact beam 103, there defines a retain slot 104. The retain slot 104 extends along the entire side surface of the contact beam 103. The retain slot 104 depresses from the surface of the contact beam 103 with the section of the retain slot 104 to be formed with a half circle shape. At one end of the retain slot 104, there defines a stop block 105, which is formed protruding slackly from the surface of the retain slot 104 and is little lower than the side surface of the contact beam 103. In said preferred embodiment, the retain slots 104 are formed on two opposite side surfaces of the contact beam 103, but, in other embodiments, the retain slots 104 and stop blocks 105 may also be formed on all four side surfaces of the contact beam 103.

The second terminal 11 has a second abutting portion 111. Extending from one end of the second abutting portion 111, there forms a second mating portion 112 for electrically connecting with an external electrical element. Extending from the other end of the second abutting portion 111, there forms a pair of elastic beams 113 used for elastically clamping said contact beam 103. The two elastic beams 113 extending from the second abutting portion 111 symmetrically. Each elastic beam 113 has a wave shape with a plurality of contact points (not labelled) formed at the inner side thereof. The two elastic beams 113 together form a retain clamp 114 with every two contact points opposite to each other, the minimal distance of two opposite contact points of the retain clamp 114 is less than the distance between the two surfaces of the retain slots 104. When the contact beam 103 is inserted into the retain clamp 114, the two elastic beams 113 bent outwards, so the retain clamp 114 is able to clamp the retain slot 104 through the plurality of contact points under the return force of the elastic beams 113. As mentioned above, in other embodiments, the retain slots 104 may be formed on four side surfaces of the contact beam 103, accordingly, in other embodiments the elastic beams 113 may be four beams extending from the abutting portion 111.

Please mainly refer to FIG. 1, when assembling, firstly, encircle the spring 12 out side of the elastic beams 113 of the second terminal 11, and press the spring 12 to expose the ends of the elastic beams 113 outside, then mate the elastic beams 113 with the contact beam 103 of the first terminal 10, the elastic beams 113 run over the stop block 105 and be received in the retain slots 104 with the contact points clamping the surfaces of the retain slots 104, finally, release the spring 12, the assembling is finished. When the spring 12 is on a flabby status, the end of the retain clamp 114 hold the stop block 105 to retain the first terminal 10 and the second terminal 11 together, that makes the contact 20 to be an integer so as to convenient for moving, assembling or change the product. The width of the first abutting portion 101 and the second abutting portion 111 is larger than the diameter of the spring 12 to avoid the spring 12 slipping off from the terminals. When the contact 20 is inserted into an insulating housing of a connector (not shown), the contact 20 can only move up and down limited by the passage of the housing. When the connector is used to connect a chip with a circuit board, the first terminal 10 is pressed by the chip and moves towards the second terminal 11, the two elastic beams 113 deflect outwards and move within the retain slot 104 of the contact beam 103, under the elastic resume force, the elastic beams 114 clamp the contact beam 103 tightly. The first abutting portion 101 and the second abutting portion 111 press the spring 12 from two sides, the first mating portion 102 touches with the chip tightly put by the resume force from the spring 12. When remove the chip, the first terminal 10 will return to the original position pushed by the spring 12.

Comparing with the conventional connector contact, the connector contact 20 according with the present invention is a monolithic linear shape, the passage for receiving the contact 20 only need to prevent the contact to rock left or right in the passage, whereby, the assembling become convenient. On the other hand, the first terminal 10 adapts a retain slot 104 to limit the moving track of the elastic beam 113 of the second terminal 11, and the retain clamp 114 is formed, in a serpentine shape, with a plurality of contact points, that all can ensure the miss mating and bad connecting between the two terminals won't occur during the moving process, so as to achieve a good electrical performance. Furthermore, the stop block 105 mates with the end of the retain clamp 114 of the elastic beam 113 to make the connector contact 20 to be an integer, that's convenient for moving, assembling or changing the product.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector contact adapted for connecting a chip to a circuit board, comprising:

a first terminal having a first abutting portion and a contact beam extending from one end of the first abutting portion;

a second terminal electrically connecting with the first terminal, which has a second abutting portion and an elastic beam extending from one end of the second abutting portion;

a spring set between and abutting the first abutting portion and the second abutting portion;

wherein, a retain slot is formed on the surface of the contact beam, and said elastic beam abuts with and be retained in the retain slot;

wherein at the end of the retain slot, there defines a stop block protruding from the inner wall of the retain slots, which mates with a retain clamp to hold the two terminals together as the spring is in an original status.

2. The electrical connector contact of claim 1, wherein the elastic beam of the second terminal comprises a pair of elastic beams extending symmetrically from the second abutting portion.

3. The electrical connector contact of claim 2, wherein each of said elastic beams has a wave shape with a plurality of opposite contact points formed at the inner side thereof, and the opposite contact points form the retain clamp.

4. The electrical connector contact of claim 3, wherein the retain slot forms on both side surfaces of the contact beam, and the minimum distance between two opposite contact points is less than the transverse distance between the two retain slots.

5. The electrical connector contact of claim 4, wherein the retain clamp is received in the retain slot of the contact beam and mates with an inner wall of the retain slot tightly.

6. An electrical connector contact comprising:

an elongated first terminal defining a first mating portion and a first contact portion with a first abutment portion located therebetween;

an elongated second terminal defining a second mating portion and a second contact portion with a second abutment portion therebetween;

said first terminal and said second terminal assembled to each other with the first contact portion and the second contact portion interengaged with each other and commonly surrounded in a coil spring having two opposite ends abutting against the first abutment portion and the second abutment portion respectively; wherein the second contact portion defines a pair of retaining clamps commonly sandwiching a blade type first contact portion therebetween; wherein each of said pair of retaining clamps defines a serpentine configuration to provide multiple contact points during engagement with the first contact portion which provides a plane to cooperate with each of said pair of retaining clamp;

wherein a pitch between every adjacent two contact points increases away from the second abutment portion;

wherein said blade type first contact portion defines a pair of independent retaining slots on two respective faces therein to receive the corresponding pair of retaining clamps, respectively, so as to prevent relative rotation between the first terminal and the second terminal.

7. The electrical connector contact of claim 1, wherein the width of the first abutting portion and the second abutting portion is larger than the diameter of the spring.

8. An electrical connector contact comprising:

an elongated first terminal defining a first mating portion and a first contact portion with a first abutment portion located therebetween;

an elongated second terminal defining a second mating portion and a second contact portion with a second abutment portion therebetween;

said first terminal and said second terminal assembled to each other with the first contact portion and the second contact portion interengaged with each other and commonly surrounded in a coil spring having two opposite ends abutting against the first abutment portion and the second abutment portion respectively; wherein the second contact portion defines a pair of retaining clamps commonly sandwiching a blade type first contact portion therebetween under condition that said pair of retaining clamps are outwardly deflectably seated upon two opposite faces of the first contact portion when said first terminal and said second terminal approach to each other and the coil spring is compressed;

wherein said blade type first contact portion defines a pair of independent retaining slots substantially extending the entire length on two respective faces therein to receive the corresponding pair of retaining clamps, respectively, so as to prevent relative rotation between thre first terminal and the second terminal.

9. The electrical connector contact as claimed in claim 8, wherein each of said pair of retaining clamps defines a serpentine configuration to provide multiple contact points during engagement with the first contact portion.

10. The electrical connector contact as claimed in claim 9, wherein a pitch between every adjacent two contact points increases away from the second abutment portion.

11. The electrical connector contact as claimed in claim 6, wherein said first terminal is stiff while the second terminal is flexible during assembling.

12. The electrical connector contact as claimed in claim 8, wherein said first terminal is stiff while the second terminal is flexible during assembling.

13. The electrical connector contact as claimed in claim 8, wherein said first terminal essentially lies in a first plane while the second terminal lies in a second plane perpendicular to said first plane.

14. The electrical connector contact as claimed in claim 6, wherein said first terminal essentially lies in a first plane while the second terminal lies in a second plane perpendicular to said first plane.

* * * * *